US005176489A

United States Patent [19]

Schröter

[11] Patent Number: 5,176,489

[45] Date of Patent: Jan. 5, 1993

[54] LEVELLER BAR FOR A COKE OVEN BLOCK

[75] Inventor: Horst Schröter, Viersen, Fed. Rep. of Germany

[73] Assignee: Hartung, Kuhn & Co. Maschinenfabrik GmbH, Kassel, Fed. Rep. of Germany

[21] Appl. No.: 764,144

[22] Filed: Sep. 20, 1991

[30] Foreign Application Priority Data

Oct. 29, 1990 [DE] Fed. Rep. of Germany ..... 4034342

[51] Int. Cl.[5] ..... C10B 45/00; C10B 37/02

[52] U.S. Cl. ..... 414/587

[58] Field of Search ..... 414/587, 166, 198; 202/239, 262, 270

[56] References Cited

U.S. PATENT DOCUMENTS

| | | | |
|---|---|---|---|
| 907,818 | 12/1908 | Koppers | 414/587 |
| 1,720,805 | 7/1929 | Van Ackerman et al. | 414/587 |
| 1,937,734 | 12/1933 | Underwood | 414/587 |
| 2,234,827 | 3/1941 | Koppers | 414/587 |
| 3,207,334 | 9/1965 | Becker | 414/587 |
| 3,616,947 | 11/1971 | Tucker | 414/587 |
| 3,618,794 | 11/1971 | Helm | 414/587 X |
| 4,181,578 | 1/1980 | Stauffer et al. | 414/587 X |
| 4,555,209 | 11/1985 | Berenato, III et al. | 414/587 X |

*Primary Examiner*—David A. Bucci
*Attorney, Agent, or Firm*—Michael J. Striker

[57] ABSTRACT

The leveller bar for leveling a coal heap formed during a charging process under charging holes of an oven compartment of a coke oven block has two vertical plates connected with each other and spaced parallel from each other a distance (a) according to a width of the oven compartment and spaced from each other by spacing rods. Each deflecting and entraining device (2) does not extend over the entire distance a between the vertical plates (1) and the coal deflecting and entraining devices (2) extend alternately successively from one or the other of the plates (1) toward the opposite plate. Advantageously they can be equal-sided angular sections.

5 Claims, 1 Drawing Sheet

Fig. 1
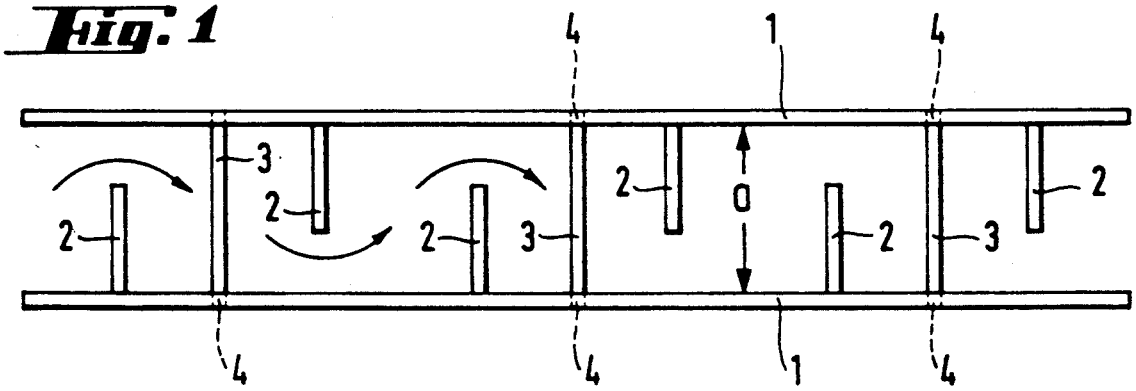
Fig. 2
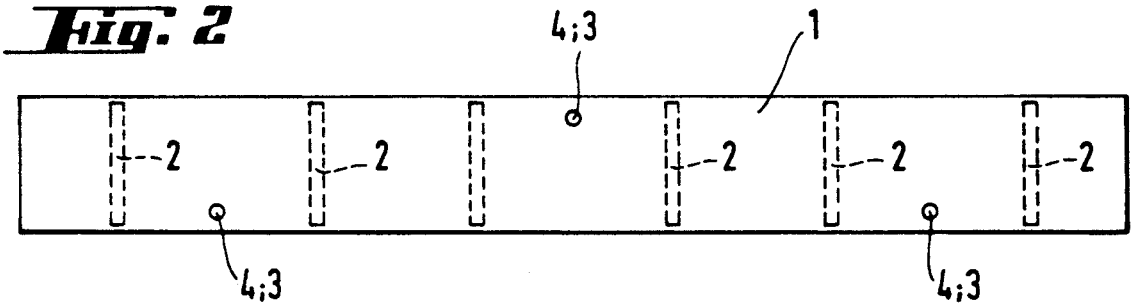
Fig. 3
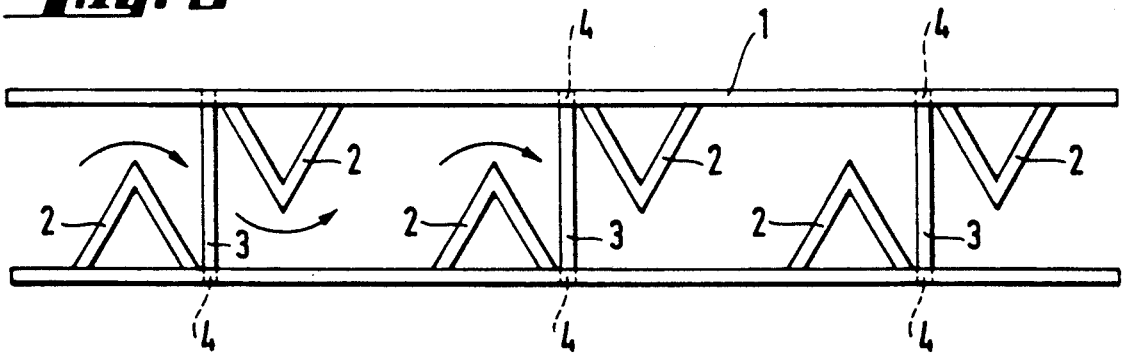
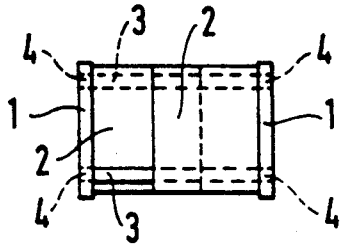
Fig. 4

LEVELLER BAR FOR A COKE OVEN BLOCK

BACKGROUND OF THE INVENTION

The present invention relates to a leveller bar for a coke oven block.

A leveller bar for leveling the coal heap formed during the charging process under the charging holes of the oven compartment of the coke oven block is known. This leveller bar comprises two vertical plates connected with each other and spaced parallel from each other depending on the width of the oven compartment. In the intervening space between the plates several transverse coal deflecting and/or entraining devices are positioned behind each other.

The leveller bars used for leveling the coal chute cone formed during the charging process in the oven compartment, which are moved back and forth mechanically, should have the simplest, but also a durable, structure. Therefore, up to now leveller bars have been used, in which the so-called coal deflecting and/or entraining devices were formed in the shape of cross plates, which are welded at right angles to the vertical plates and connected simultaneously with each other. That means that the deflecting and/or entraining devices extend in this case over the entire width of the intervening space between the vertical plates. The number and the spacing of the coal deflecting and/or entraining devices is dependent on the number and spacing of the charging holes in the oven compartment and on the horizontal motion of the leveller bar.

Known leveller bars of the above-described type are generally adequate. The coal charging car either is equipped with a charging gas exhaust and dedusting device or stationary gas exhaust and dedusting devices are installed in the coke oven block, which exhaust the charging gases during the charging process vertically through the charging holes and conduct the cleaning.

Both according to the current legal requirements (TA Air) in the Federal Republic of Germany and also the new international legal Rules the charging gas should no longer be drawn through the charging holes, but as much as possible it should be conducted through the ascension pipe into the gas collecting main. Moreover a pump or fan device is to be installed in the ascension pipe, for example, a steam or power water pump, which can produce a low pressure in the oven compartment. With this changed type of charging gas exhaust, the coal charging car must be equipped with a so-called telescoping sealing device, which closes against the charging hole frame making a tight seal. As long as the coal heap has not reached the gas collection chamber in the oven compartment, the charging gas can flow to the gas collecting main comparatively unhindered, also when the conventional leveller bar structure is present. This situation changes however, as soon as the coal heap reaches the lower leveller bar edges, which means when the leveling process begins. Then the horizontal flow of the charging gas to the gas collecting main through the coal deflection and entraining devices, which extend across the entire width of the leveller bar, is strongly hindered. The deflection and entraining devices at certain positions of the leveller bar provide that the free flow of charging gas is partitioned and controlled correctly. Since the charging gas can reach the gas collecting main in all cases through the remaining narrow gap between the leveller bar and the walls of the oven compartment under great difficulty, this leads of necessity to a higher pressure in the oven compartment. The sealing at the charging hole frame cannot withstand this increased pressure. Thus a rather more or less strong uncontrolled emission occurs at the charging hole frame, which naturally is completely undesirable in the interests of maintaining air quality. The pump or fan device installed in the ascension pipes could take care of this emission in all cases with a high efficiency. However that solution leads understandably to high installation and operating cost.

SUMMARY OF THE INVENTION

It is an object of the present invention to provide an improved leveller bar for a coke oven block, by which the above described disadvantages are avoided and which is suitable for use with a coke oven block, in which the exhaust of charging gases through the gas collecting main is required.

According to the present invention, the leveller bar of the above-described type, is characterized by a plurality of spacing rods supporting and holding the vertical plates at the sides of the leveller bar spaced from each other, and each of the coal deflecting and the entraining devices do not extend over the entire distance a from one plate to the other and the coal deflecting and entraining devices extend alternately successively from one plate or the other toward the opposite plate. By "alternately successively" we mean that each of the coal deflecting and entraining devices extends from the plate opposite from the plate from which the adjacent ones extend.

The leveller bar of the invention is different from the known leveller bar structure in that the coal deflecting and entraining devices do not extend over the entire width of the intervening space and are *not* simultaneously the connecting members between the two vertical plates. Instead of that the coal deflecting and entraining devices extend only over a portion of the width, advantageously however over at least half the width or the distance a. The connection of both vertical plates to each other occurs by the spacing rods, which can be attached alternately successively at the upper or lower edges of the plates.

In another embodiment of the invention the coal deflecting and entraining devices can be plates or sheets provided with reinforcements and/or with supports. Instead of this, in other embodiments of the invention equal-sided angular sections for increasing the stability can be used as deflecting and entraining devices with different angles between the sides.

The number of deflecting and entraining devices arranged in succession depends on the number and spacing of the charging holes in the oven compartment and the horizontal motion of the leveller bar.

The leveller bar according to the invention has the advantage that the charging gas can flow out unhindered between both vertical plates horizontally to the gas collecting main. The occurrence of increased pressure in the oven compartment is thus avoided along with the negative consequences that result therefrom. Simultaneously the capacity of the pump or fan device in the ascension pipe can be minimized, so that, on the one hand, energy can be saved and, on the other hand, coal transport in the ascension pipe can be avoided.

BRIEF DESCRIPTION OF THE DRAWING

The objects, features and advantages of the present invention will now be illustrated in more detail by the following detailed description, reference being made to the accompanying drawing in which:

FIG. 1 is a top plan view of a first embodiment of a leveller bar of a coke oven block according to the present invention, FIG. 2 is a side view of the leveller bar of FIG. 1;

FIG. 3 is a top plan view of a second embodiment of a leveller bar of a coke oven block according to the present invention, and FIG. 4 is a front plan view of the leveller bar according to FIG. 3.

DETAILED DESCRIPTION OF THE PREFERRED EMBODIMENTS

The leveller bar shown in FIG. 1 comprises two vertical plates 1, which form the lateral boundaries or the sides of the leveller bar. These plates 1 spaced a distance a, which determines the width of the leveller bar, are arranged parallel to each other and are connected rigidly with each other by the spacing rods 3. The spacing or distance a is designed or chosen understandably according to the width of the unshown oven compartment, in which the leveller bar is to be used. The dimension a is selected so that the width of the leveller bar is slightly less than the width of the oven compartment, so that between the interior walls of the oven compartment and the vertical plates 1 a certain play remains sufficient for the required horizontal motion of the leveller bar in the oven compartment. The vertical position of the plates 1 is determined from the FIGS. 2 and 4 clearly. In the embodiment shown in FIG. 1, the coal deflecting and entraining devices 2 are formed from plates or sheets, which are attached at right angles to the vertical plates 1. These transverse plates or sheets acting as deflecting and entraining devices 2 can be provided with reinforcement means or supports R. Understandably the coal deflecting and entraining devices can also be attached to the vertical plates 1 at an inclined angle instead of at right angles. The top views clearly show how the coal deflecting and entraining devices 2 extend alternatively from the one or the other of both vertical plates 1. The top views also show that, in contrast to the leveller bar known currently, the deflecting and entraining devices 2 do not extend over the entire width a of the leveller bar. Because of that, the charging gas can flow away unhindered in the horizontal direction to the unshown gas collecting main, which is indicated by the arrows in FIGS. 1 and 3.

FIG. 2 shows the side view of the leveller bar according to FIG. 1. This figure shows the points of attachment 4 of the spacing rods 3. From the position of the attachment points 4 one can see that the spacing rods 3 are located alternating on the top and bottom sides of the vertical plates 1.

A second embodiment of the invention is shown in FIG. 3. The second embodiment is similar to the first embodiment shown in FIG. 1 and reference numbers which are the same indicate components, which are the same or have the same function in both embodiments. In contrast to the first embodiment shown in FIG. 1 however the coal deflecting and entraining devices 2 are formed in the shape of equal-sided angular sections, which provides a more stable attachment to the vertical plates 1. In practice the angular sections can also have an obtuse or an acute angle, as is shown in the drawing.

FIG. 4 shows finally a view of the leveller bar of FIG. 3 from the front. The deflecting and entraining device 2 on the one hand extends over the entire height of the vertical plates 1 and on the other hand does not fill the entire width of the intervening space between both vertical plates.

While the invention has been illustrated and described as embodied in a leveller bar for a coke oven block, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. In a leveller bar for leveling a coal heap formed during a charging process under charging holes of an oven compartment of a coke oven block, said leveller bar comprising two vertical plates connected with each other and spaced parallel from each other a distance (a) determined by a width of the oven compartment, said vertical plates forming an intervening space between the plates in which a plurality of coal deflecting and entraining devices are arranged one after the other along the vertical plates, the improvement further comprising a plurality of spacing rods (3) spacing and holding the plates (1) from each other, and wherein each of the coal deflecting and entraining devices (2) does not extend over the entire distance (a) between the plates (1) and each of the coal deflecting and entraining devices (2) extends from one of the plates (1) which is opposite to the plate (1) from which the adjacent ones of the deflecting and entraining devices (2) extend.

2. The improvement as defined in claim 1, wherein each of the coal deflecting and entraining devices (2) extends over at least one half of the distance (a) between the vertical plates (1).

3. The improvement as defined in claim 1, wherein the coal deflecting and entraining devices (2) each have a height and the vertical plates (1) have another height and the height of the vertical plates (1) substantially corresponds to the height of the coal deflecting and entraining devices (2).

4. The improvement as defined in claim 1, wherein each of the coal deflecting and entraining devices is plate-shaped, provided with reinforcement means and is attached to one of the plates at an angle not greater than a right angle.

5. The improvement as defined in claim 1, wherein each of the coal deflecting and entraining devices is in the form of an equal-sided angular section.

* * * * *